US005308939A

United States Patent [19]

Sasaki

[11] Patent Number: 5,308,939

[45] Date of Patent: May 3, 1994

[54] PRESSURE EQUALIZING MECHANISM FOR A PRESSURE SWITCH

[75] Inventor: Keiji Sasaki, Zama, Japan

[73] Assignee: Fuji Koki Manufacturing Co., Ltd., Tokyo, Japan

[21] Appl. No.: 973,879

[22] Filed: Nov. 10, 1992

[30] Foreign Application Priority Data

Jul. 21, 1992 [JP] Japan ..... 4-051157
Jul. 21, 1992 [JP] Japan ..... 4-051158

[51] Int. Cl.[5] ..... H01H 35/34

[52] U.S. Cl. ..... 200/83 R; 73/723; 200/82 R; 200/83 W; 200/302.1

[58] Field of Search ..... 200/81.4, 81.5, 82 R, 200/83 R, 83 A, 83 B, 83 P, 83 J, 83 W, 284, 302.1, 306; 91/1; 92/5 R, 78; 73/717, 723, 745; 340/626; 307/118

[56] References Cited

U.S. PATENT DOCUMENTS 3,154,652 10/1964 Gilman ..... 200/83 W
4,037,317 7/1977 Bauer ..... 29/622
4,524,254 6/1985 Yoshida ..... 200/83 R
4,939,321 7/1990 Tanaka et al. ..... 200/83
5,122,628 6/1992 McLelland ..... 200/834

FOREIGN PATENT DOCUMENTS 64-27137 1/1989 Japan .

*Primary Examiner*—Gerald P. Tolin
*Attorney, Agent, or Firm*—Kenyon & Kenyon

[57] ABSTRACT

An inner space of an outer case is partitioned by a gas permiable diaphragm into a fluid pressure operating chamber and a reference pressure operating chamber. The former chamber communicates with a pressurized fluid inlet hole formed in the case, and the latter communicates with a pressure equalizing hole formed in the case. Electrical contacts are stored in the latter chamber to perform on/off-operation in response to deflection of the diaphragm caused by pressure change of pressurized fluid in the former chamber. Outer connection terminals for the contacts are supported by the outer case. A filter is provided in the equalizing hole.

1 Claim, 4 Drawing Sheets

PRESSURE EQUALIZING MECHANISM FOR A PRESSURE SWITCH

BACKGROUND OF THE INVENTION

1. Field of the Invention

The present invention relates to a pressure switch, and more particularly to a pressure switch comprising an outer case which has a fluid inlet hole and a pressure equalizing hole being independent of the fluid inlet hole and being adapted to communicate with an outer space, a diaphragm which partitions an inner space of the outer case into a fluid pressure operating chamber communicating with the fluid inlet hole and a reference pressure operating chamber communicating with the pressure equalizing hole, electrical contact means, stored in the reference pressure operating chamber, for performing on/off-operation in accordance with deflection of the diaphragm caused by the pressure change of fluid flowed into the fluid pressure operating chamber through the fluid inlet hole, and an outer connection electrical terminal which is supported by the outer case for the electrical contact means.

2. Description of the Related Art

This type of pressure switch is used in, for example, an airconditioner for an automobile, and its structure is disclosed in, for example, Published Unexamined Japanese Patent No. 64-27137 and U.S. Pat. No. 4,939,321.

In the conventional pressure switch, plastic is selected as material of the diaphragm by taking a pressure response characteristic and a lifetime into consideration. Plastic has, however, a slight gas permeability.

The pressure equalizing hole applies atmospheric pressure as a reference pressure on the reference-pressure-operating-chamber-side side surface of the diaphragm. In addition, the pressure equalizing hole functions to prevent slight gas, which permeate from the fluid-pressure-operating-chamber-side side surface (the pressure-sensing-side surface) into the reference-pressure-operating-chamber-side side surface of the diaphragm due to the gas permeability of the diaphragm material, from affecting the reference pressure.

FIGS. 1A and 1B show a longitudinal sectional view of a conventional pressure equalizing hole 14 formed in a part of the inner surface of a connection terminal insertion hole 12 of an outer case 10, and a plane view thereof, respectively. As apparent from these figures, the pressure equalizing hole 14 is formed along all over a longitudinal side (having a maximum size L) of an outer peripheral surface in a cross section of an outer connection electrical terminal 16 inserted into an outer connection electrical terminal insertion hole 12.

In the above-structured conventional pressure switch, there is a possibility that, dust enters into the reference pressure operating chamber of the inner space of the outer case through the pressure equalizing hole and is adhered to the electrical contact means stored in the reference pressure operating chamber, and causes defectiveness of electrical conductivity in the electrical contact means, when the pressure switch is used in the airconditioner for an automobile.

SUMMARY OF THE INVENTION

In consideration of the above problem, the present invention has been made, and an object of the present invention is to provide a pressure switch comprising: an outer case which has a fluid inlet hole and a pressure equalizing hole being independent of the fluid inlet hole and being adapted to communicate with an outer space; a diaphragm which partitions an inner space of the outer case into a fluid pressure operating chamber communicating with the fluid inlet hole and a reference pressure operating chamber communicating with the pressure equalizing hole; electrical contact means, stored in the reference pressure operating chamber, for performing on/off-operation in accordance with deflection of the diaphragm caused by the pressure change of fluid flowed into the fluid pressure operating chamber through the fluid inlet hole; and an outer connection electrical terminal which is supported by the outer case for the electrical contact means, wherein the introduction of atmospheric pressure, which serves as a reference pressure, into the reference pressure operating chamber can be sufficiently ensured, affection of gas, which slightly permeats from the pressure sensing side surface of the diaphragm into the reference pressure side surface, to the reference pressure can be sufficiently removed, dust can be sufficiently prevented from entering into the reference pressure operating chamber of the inner space through the pressure equalizing hole so that defectiveness of electrical conductivity, due to adhesion of dust to the electrical contact means in the reference pressure operation chamber, can be sufficiently prevented, and its structure is simple to be easily manufactured.

In order to achieve the above object, according to the present invention, there is provided a pressure switch comprising: an outer case which has a fluid inlet hole and a pressure equalizing hole being independent of the fluid inlet hole and being adapted to communicate with an outer space; a diaphragm which partitions an inner space of the outer case into a fluid pressure operating chamber communicating with the fluid inlet hole and a reference pressure operating chamber communicating with the pressure equalizing hole; electrical contact means, stored in the reference pressure operating chamber, for performing on/off-operation in accordance with deflection of the diaphragm caused by the pressure change of fluid flowed into the fluid pressure operating chamber through the fluid inlet hole; and an outer connection electrical terminal which is supported by the outer case for the electrical contact means, wherein the outer connection electrical terminal is supported by the outer case by being inserted into an outer connection electrical terminal insertion hole formed in the outer case, and the pressure equalizing hole is formed in the inner surface of the outer connection electrical terminal insertion hole of the outer case as a groove having a cross section with a smaller size than the minimum size of the cross section of the outer connection electrical terminal.

Also, in order to achieve the above object, according to the present invention, there is provided a pressure switch comprising: an outer case which has a fluid inlet hole and a pressure equalizing hole being independent of the fluid inlet hole and being adapted to communicate with an outer space; a diaphragm which partitions an inner space of the outer case into a fluid pressure operating chamber communicating with the fluid inlet hole and a reference pressure operating chamber communicating with the pressure equalizing hole; electrical contact means, stored in the reference pressure operating chamber, for performing on/off-operation in accordance with deflection of the diaphragm caused by the pressure change of fluid flowed into the fluid pressure operating chamber through the fluid inlet hole; and an outer connection electrical terminal which is supported by the outer case for the electrical contact means, wherein a filter is provided in the pressure equalizing hole.

The pressure equaling hole formed with a size described in the former pressure switch can sufficiently ensures introduction of atmospheric pressure, serving as a reference pressure, into the reference pressure operation chamber through the pressure equalizing hole, can sufficiently discharge gas, which slightly permeats from the pressure sensing side surface of the diaphragm into the reference pressure side surface, to an outer space through the pressure equalizing hole so that affection of the gas to the reference pressure in the reference pressure operating chamber can be sufficiently removed. Moreover, dust can be sufficiently prevented from entering into the reference pressure operating chamber of the inner space through the pressure equalizing hole.

In the latter pressure switch, the filter can take the same technical advantage as those obtained in the former pressure switch and described above.

It is preferable that the filter is detachable, and is formed of material having meshes of substantially 10 micrometer and being suitable for environment in which the pressure switch is used.

One example of the above material is nylon 66.

As a filter, a film made of PTFE (polytetrafluoroethylene) adjusted to function as the filter can be used.

For example, a PTFE film which has gas and vapor permeability and waterproof and can be purchased as a trade name "Gore-Tex" can be used for the filter.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

One Embodiment

An embodiment of a pressure switch of the present invention will be explained with reference to FIGS. 2A to 3B.

Figure 2A:
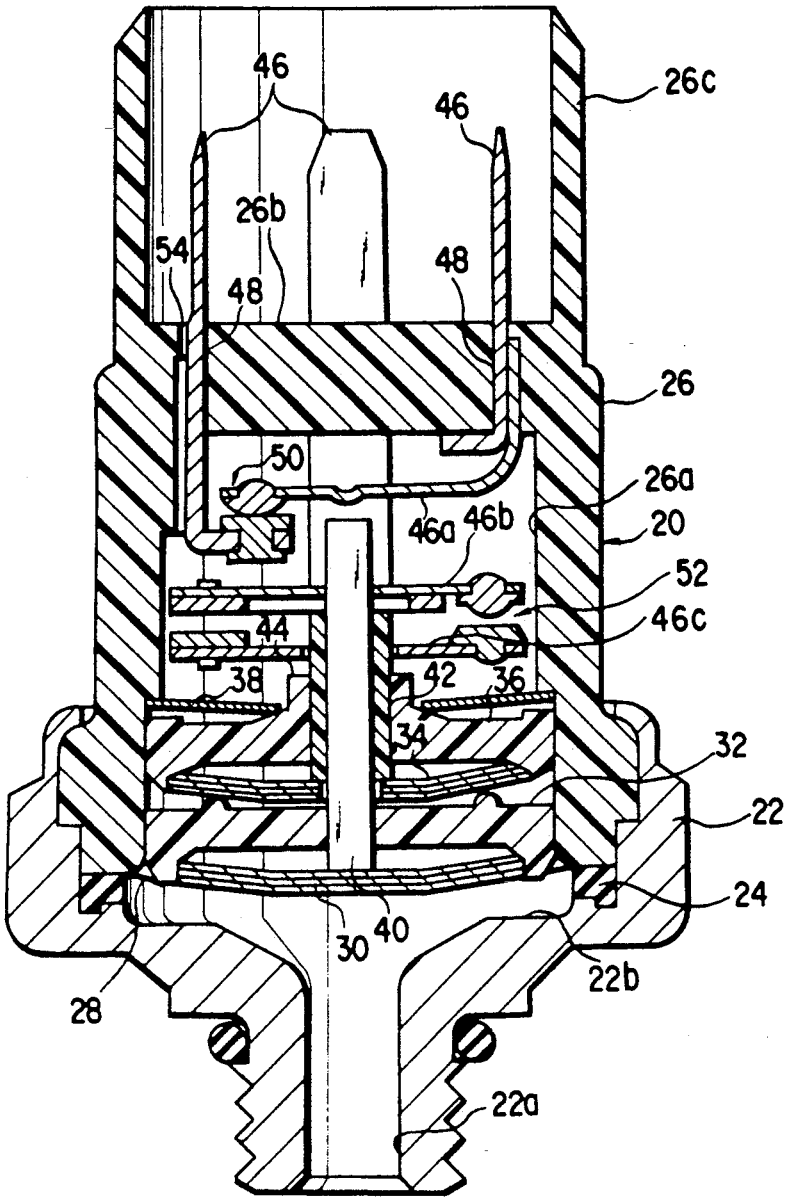
FIG. 2A is a longitudinal sectional view of a pressure switch according to one embodiment of the present invention.
Figure 2B:
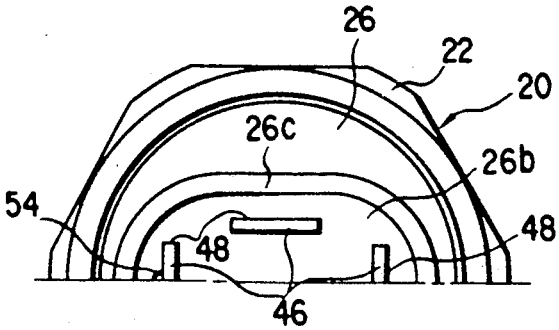
FIG. 2B is a half plane view of the pressure switch of FIG. 2A.

FIG. 2A is a longitudinal sectional view of one embodiment of a pressure switch of the present invention, and FIG. 2B is a plane view of the above described one embodiment of FIG. 2B.

In this embodiment, a pressure switch of this embodiment is a three-action type. As shown in FIG. 2A, an outer case 20 has a cap-like pressurized fluid inlet portion 22 made of metal and a cylindrical reference pressure portion 26. In an end wall of the pressurized fluid inlet portion 22 a fluid inlet hole **22*a* adapted to be connected to a refrigerative cycle pipe (not shown) of an airconditioner for an automobile is formed, and the reference pressure portion 26 is closed at its one end and is connected at it opened other end to the pressure fluid inlet portion 22** with a rubber made annular sealing material being interposed therebetween.

The reference pressure portion 26 is made of non-conductive synthetic resin such as PBT (polybutylene terephthalate).

An inner space (fluid pressure operating chamber) **22*b* of the pressure fluid inlet portion 22 and an inner space (reference pressure operating chamber) 26*a* of the reference pressure portion 26 are partioned by a diaphragm 28 whose peripheral portion is held by the annular sealing portion 24** in a sealing state.

As the diaphragm 28, a film made of, for example, synthetic resin is used in order to rapidly respond to pressure of the pressurized fluid flowing into the fluid pressure operating chamber **22*b* of the pressurized fluid inlet portion 22** and deflect, and to ensure its long lifetime. However, this synthetic resin made film has slight gas permeability to the pressurized fluid.

In the reference pressure operating chamber **26*a* of the reference pressure portion 26, a first pressure receiving piston 32 which supports a first coned disc spring member 30 arranged to be adjacent to the diaphragm 28 and constituted by stacking a plurality of coned disc springs, and a second pressure receiving piston 36 which supports a second coned disc spring member 34 arranged to be adjacent to the first pressure receiving piston 32** and constituted by stacking a plurality of coned disc springs.

These first and second pressure receiving pistons 32 and 36 are urged toward the diaphragm 28 by a third coned disc spring member 38 interposed between a side surface of the second pressure receiving piston 36 being positions at a back side of another side surface facing to the first pressure receiving piston 32 and an inner peripheral surface of the reference pressure operating chamber 26*a* of the reference pressure portion 26. Then, the second coned disc spring member 34, which is held by the second pressure receiving piston 36, is brought into contact with the first pressure receiving piston 32, and the first coned disc spring member 30, which is held by the first pressure receiving piston 32, is brought into contact with the diaphragm 28.

A central portion of the first coned disc spring member 30 floats from the corresponding supporting surface of the first pressure receiving piston 32 toward the diaphragm 28. A central portion of the second coned disc spring member 34 floats from the corresponding surface of the second pressure receiving piston 36 toward the first pressure receiving piston 32.

One end of a first cylindrical push rod 40 abuts against the central portion of a first-pressure-receiving-piston-side side surface of the first coned disc spring member 30, and the other end of the first cylindrical push rod 40 passes through the first pressure receiving piston 32, the second coned disc spring member 34, and the second pressure receiving piston 36 to extend toward the closed end of the reference pressure portion 26. The first push rod 40 is supported by the first pressure receiving piston 32 to be freely slidable in its longitudinal direction.

Further, the first push rod 40 is inserted into a central hole of a second cylindrical push rod 42 to be freely slidable in its longitudinal direction, and one end of the second cylindrical push rod 42 abuts against the central portion of a second-pressure-receiving-piston-side surface of the second coned disc spring member 34 and passes through the second pressure receiving piston 36 to extend toward the closed end portion of the reference pressure portion 26.

A third cylindrical push rod 44 is formed on a side surface of the second pressure receiving piston 36, being facing to the closed one end of the reference pressure portion 26, to enclose the second push rod 42 and supports the second push rod 42 to be freely slidable in its longitudinal direction.

The projecting lengths of the first, second, and third push rods 40, 42, and 44 projecting from the third coned disc spring member 38 toward the closed one end of the reference pressure portion 26 are shorter in the above described order.

As shown in FIGS. 2A and 2B, two pairs of connection terminals 46 are fixed to an end wall 26*b* of the closed one end of the reference pressure portion 26 of the outer case 20 to project in a longitudinal direction of the reference pressure portion 26. Outer projecting portions of the four connection terminals 46 are enclosed by an annular protection skirt portion 26*c*, which is formed on the end wall 26*b* to project in the longitudinal direction of the reference pressure portion 26, and are protected by the skirt portion 26*c* from external force.

The four connection terminals 46 are forcibly inserted into connection terminal insertion holes 48 formed at predetermined positions of the end wall 26*b*, thereby fixing them to the end wall 26*b*.

As shown in FIGS. 2A and 2B, in the reference pressure operating chamber 26*a* of the reference pressure portion 26, inner end portions of the paired connection terminals 46 constitute normally closed switch 50 using one elastic contact piece 46*a*. The elastic contact piece 46*a* of the normally closed switch 50 faces to the projected end surface of the first push rod 40. In the reference pressure operating chamber 26*a* of the reference pressure portion 26, inner end portions of the other paired connection terminals 46 constitute a normally open switch 52 using two elastic contact pieces 46*b* and 46*c*. The first push rod 40 passes through the two elastic contact pieces 46*b* and 46*c* to be freely movable in its longitudinal direction. Also, the second push rod 42 passes through the elastic contact piece 46*b*, positioned near to the third coned disc spring member 38, to be freely movably in its longitudinal direction.

In the normally open switch 52, the second push rod 42 does not pass through the elastic contact piece 46*b*, being positioned far away from the third coned disc spring member 38, and the projected end surface of the second push rod 42 faces to the elastic contact piece 46*b*. Moreover, the third push rod 43 does not pass through the elastic contact piece 46*c*, being positioned near to the third coned disc spring member 38, and the projected end surface of the third push rod 44 faces to the elastic contact piece 46*c*.

In the end wall 26*b* of the reference pressure portion 26 of the outer case 20, a pressure equalizing hole 54 for communicating the reference pressure operating chamber 26*a* of the reference pressure portion 26 with an outer space is formed. The pressure equalizing hole 54 is formed in a part of the inner surface of one of the four connection terminal insertion holes 48 for the four connection terminals 46. As particularly shown in FIGS. 3A and 3B, the pressure equalizing hole 54 is formed by a groove having a size S, which is smaller than the minimum size in the horizontal cross section of the corresponding connection terminal 46.

The pressure equalizing hole 54 opens in a region of the end wall 26*b* enclosed by the protection skirt portion 26*c*. When a connection plug (not shown) is connected to two pairs of connection terminals 46 enclosed by the protection skirt portion 26*c*, the pressure equalizing hole 54 is covered by the connection plug. However, the communication through the pressure equalizing hole 54 can be ensured.

The pressure equalizing hole 54 is formed together with the four connection terminal insertion holes 48 when the reference pressure portion 26 is integrally formed by an injection molding. Then, a horizontal cross section of the pressure equalizing hole 54 is hemispherically shaped so as to prevent burr from being produced in the pressure equalizing hole when the reference pressure portion 26 is formed integrally with the pressure equalizing hole and to prevent the pressure equalizing hole from being broken after the reference pressure portion 26 is formed integrally with the pressure equalizing hole.

In this embodiment, the size S (width) in the horizontal cross section of the pressure equalizing hole 54 is set to 0.3 mm. Moreover, a height H from the region in the inner surface of the connection terminal insertion hole 48, in which the pressure equalizing hole 54 is formed, to a top end of the pressure equalizing hole 54 in its horizontal cross section is set to 0.03 mm, and its horizontal cross sectional area is 0.0061 $mm^2$.

Figure 1A:
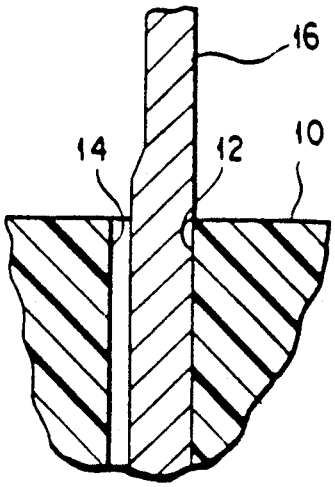
FIG. 1A (PRIOR ART)
FIG. 1A is an enlarged longitudinal sectional view showing a part of an outer case of a conventional pressure switch, at which an outer connection electrical terminal insertion hole and a pressure equalizing hole are formed, and an outer connection electrical terminal inserted into the outer connection electrical terminal insertion hole.
Figure 1B:
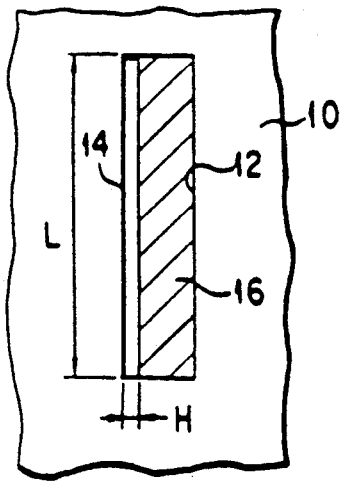
FIG. 1B (PRIOR ART)
FIG. 1B is a plane view of the part of FIG. 1A.

In the conventional pressure equalizing hole 14, which is structured as shown in FIGS. 1A and 1B and applied to the same three-action type pressure switch as the three-action type pressure switch of the embodiment of the present invention shown in FIGS. 2A and 2B, the size L (width) in the horizontal cross section is set to 6 mm. The height H from the region in the inner surface of the connection terminal insertion hole 12, in which the pressure equalizing hole 14 is formed, to a top edged of the equalizing hole 14 is set to 0.1 mm, and its horizontal cross sectional area is 0.6 $mm^2$.

Therefore, 0.0061 $mm^2$ of the horizontal cross sectional area of the pressure equalizing hole 54 of this embodiment is substantially 1/98 of 0.6 $mm^2$ of the horizontal cross sectional area of the conventional pressure equalizing hole 14. Due to this, according to this embodiment of the present invention, air can sufficiently pass therethrough, but the amount of dust which can pass therethrough is largely reduced.

The pressure equalizing hole 54 of this embodiment communicates the reference pressure operating chamber 26*a* of the reference pressure portion 26 with the outer space in order to apply atmospheric pressure, serving as reference pressure, to the reference pressure operating chamber 26*a* of the reference pressure portion 26, which is isolated by the diaphragm 28 from the fluid pressure operating chamber 22*b* of the pressurized fluid inlet portion 22, and prevent gas of pressurized fluid, which is slightly permeated from the pressure fluid inlet hole 22*a* of the pressurized fluid inlet portion 22 by the gas permeability of the material of the diaphragm 28, from affecting the reference pressure.

In the above-structured pressure switch of the embodiment, if the pressure of the pressurized fluid, which flows into the fluid pressure operating chamber 22*b* of the pressurized fluid inlet portion 22, reaches a first predetermined value, the third coned disc spring member 38 is firstly deflected toward the end wall 26*b* of the reference pressure portion 26 of the outer case 20 so that the first and second pressure receiving pistons 32 and 36 are moved toward the end wall 26*b*.

Then, the first, second, and third push rods 40, 42, and 44 are also moved together with the first and second pressure receiving pistons 32 and 36 to make the projected end of the third push rod 44 push the elastic contact piece 46*c* of the normally open switch 52 being positioned near to the third coned disc spring member 38, and the normally open switch 52 is turned on.

If the pressure of the pressurized fluid, which flows into the fluid pressure operating chamber 22*b* of the pressurized fluid inlet portion 22, reaches at a second predetermined value, which is larger than the first predetermined value, the first coned disc spring member 30, which is supported by the first pressure receiving piston 32, is deflected so that the first push rod 40 pushes the elastic contact piece 46*a* of the normally close switch 50 to turn off the normally close switch 50.

If the pressure of the pressurized fluid, which flows into the fluid pressure operating chamber 22*b* of the pressure fluid inlet portion 22, reaches at a third predetermined value, which is larger than the second predetermined value, the second coned disc spring member 34, which is supported by the second pressure receiving piston 36, is deflected so that the second push rod 42 pushes the elastic contact piece 46*b* of the normally open switch 52, which is positioned far away from the third coned disc spring member 34, to turn off the normally open switch 52.

In the above embodiment, the pressure switch is the three-action type. However, the present invention can be applied to any pressure switches in which electrical contacts are opened/closed in accordance with pressure and a pressure equalizing hole is formed in an outer case to make communicate an inner space of an outer case with an outer space.

Figure 3A:
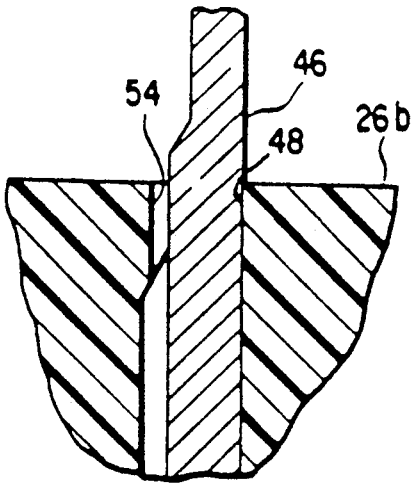
FIG. 3A is an enlarged longitudinal sectional view showing a part of an outer case of the pressure switch of FIG. 2A, in which an outer connection electrical terminal insertion hole and a pressure equalizing hole are formed, and an outer connection electrical terminal inserted into the outer connection electrical terminal insertion hole.
Figure 3B:
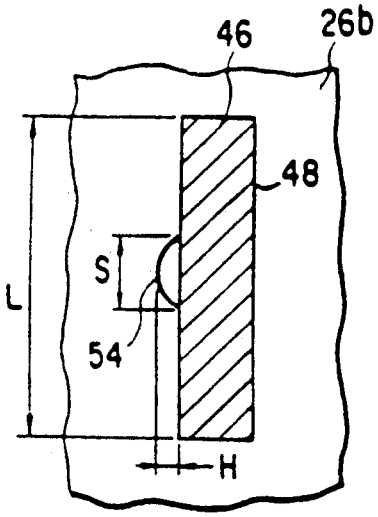
FIG. 3B is a plane view of the part of FIG. 3A.

Moreover, the shape of the horizontal cross section of the pressure equalizing hole 54 is not limited to the hemispherical shape shown in FIG. 3B. Any shapes may be used if the pressure equalizing hole will not be closed by burr or swarf produced at the time of forming the pressure equalizing hole, or if the pressure equalizing hole will not be broken after forming it.

Another Embodiment

Another embodiment of the pressure switch of the present invention will be explained with reference to FIGS. 4 to 6.

Figure 4:
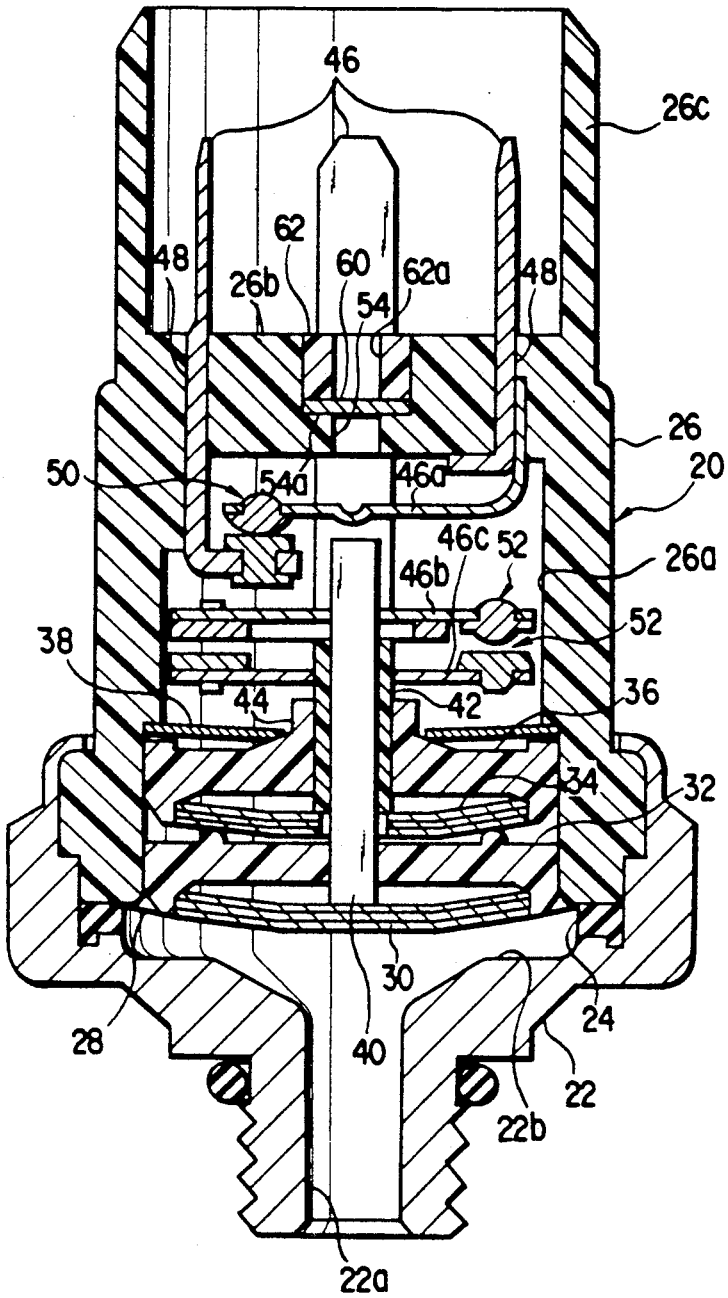
FIG. 4 is a longitudinal sectional view of a pressure switch according to another embodiment of the present invention.
Figure 5:
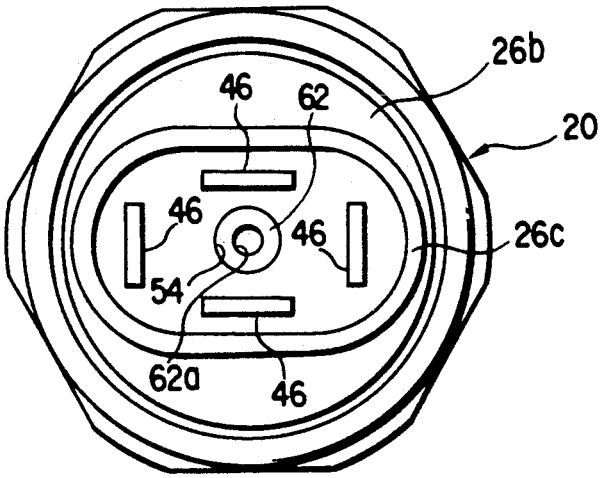
FIG. 5 is a plane view of the pressure switch of FIG. 4.
Figure 6:
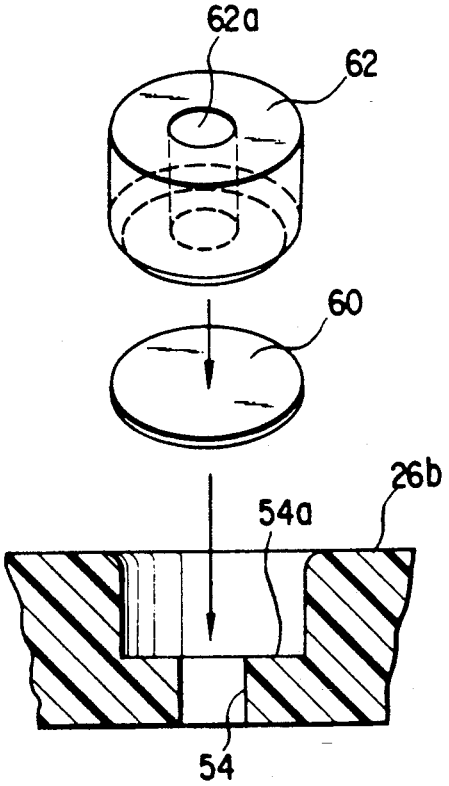
FIG. 6 is an enlarged longitudinal cross sectional view showing a part of an outer case of the pressure switch of FIG. 4, in which a pressure equalizing hole is formed, together with a filter to be detachably arranged in the pressure equalizing hole and a filter stopper.

FIG. 4 is a longitudinal sectional view showing another embodiment of the pressure switch of the present invention, and FIG. 5 is a plane view of the embodiment of FIG. 4.

The pressure switch of another embodiment is also a three-action type, and the basic structure of the pressure switch of another embodiment is the same as that of the above described one embodiment. Therefore, the same reference numerals are added to the same structural members as those of the above described one embodiment, and the detailed explanation thereof will be omitted.

Another embodiment is different from the above described one embodiment in only the structure of the pressure equalizing hole 54 formed in the end wall 26*a* of the reference pressure portion 26.

The pressure equalizing hole 54 of another embodiment opens in the region of the end wall 26*b* of the reference pressure portion 26 of the outer case 20, which is enclosed by the protection skirt portion 26*c*. When a connection plug (not shown) is connected to two pairs of connection terminals 46 enclosed by the protection skirt portion 26*c*, the pressure equalizing hole 54 is covered by the connection plug. However, the communication through the pressure equalizing hole 54 can be ensured. As shown in FIGS. 4 and 6, the outer-space-side opening of the pressure equalizing hole 54 is spot-faced to make a step 54*a*. A filter 60 is fixed in the step 54*a* by a filter stop 62. The filter 60 is woven to form meshes of substantially 10 micrometer by use of nylon 66, and air can permeate through the filter but no dust can permeate therethrough.

The filter stop 62 is formed of the same material as that of the reference pressure portion 26, and a through hole 62*a* is formed in the central portion of the filter stop 62 so as not to close the pressure equalizing hole 54. The filter stop 62 is forcibly fitted into the pressure equalizing hole 54, thereby the filter stop 62 is fixed in the pressure equalizing hole 54.

In the above described another embodiment, the pressure switch is also the three-action type. However, the present invention can be applied to any pressure switches in which the equalizing hole, electrical contacts are opened/closed in accordance with pressure and a pressure equalizing hole is formed in an outer case to make communicate an inner space of an outer case with an outer case.

Regarding the material for filter 60, as long as air can permeate through the filter 60 and no dust can permeate therethrough, material other than nylon 66, which is suitable fore the environment in which the pressure switch is used and which forms meshes other than that of substantially 10 micrometer, can be used. For example, a film made of PTFE (polytetrafluoroethylene) adjusted to function as the filter 60 can be used.

Moreover, the filter stop 62 may be formed of material, which is different from the reference pressure portion 26.

Also, it is possible to fix the filter stop 62 in the pressure equalizing hole by any suitable well-known fixing means other than the forcible fitting. Further, the filter stop 62 may be detachable fixing means, which allows to replace the filter 60 with new one when the filter 60 is clogged.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A pressure switch comprising:

an outer case which has a fluid inlet hole and a pressure equalizing hole being independent of the fluid inlet hole and being adapted to communicate with an outer space;

a diaphragm which partitions an inner space of the outer case into a fluid pressure operating chamber communicating with the fluid inlet hole and a reference pressure operating chamber communicating with the pressure equalizing hole;

electrical contact means, stored in the reference pressure operating chamber, for performing on/off-operation in accordance with deflection of the diaphragm caused by the pressure change of fluid flowed into the fluid pressure operating chamber through the fluid inlet hole; and an outer connection electrical terminal which is supported by the outer case for the electrical contact means, wherein the outer connection electrical terminal is supported by the outer case by being inserted into an outer connection electrical terminal insertion hole formed in the outer case, and the pressure equalizing hole is formed in the inner surface of the outer connection electrical terminal insertion hole of the outer case as a groove having a cross section with a smaller size than the minimum size of the cross section of the outer connection electrical terminal.

* * * * *